US008119955B2

(12) United States Patent
Park

(10) Patent No.: US 8,119,955 B2
(45) Date of Patent: Feb. 21, 2012

(54) DEVICE FOR PREVENTING LEAKAGE OF MICROWAVE FOR MICROWAVE OVEN

(75) Inventor: Kwang-Yong Park, Changwon (KR)

(73) Assignee: LG Electronics Inc., Seoul (KR)

( * ) Notice: Subject to any disclaimer, the term of this patent is extended or adjusted under 35 U.S.C. 154(b) by 509 days.

(21) Appl. No.: 11/994,905

(22) PCT Filed: Jul. 12, 2006

(86) PCT No.: PCT/KR2006/002745

§ 371 (c)(1),
(2), (4) Date: Jan. 7, 2008

(87) PCT Pub. No.: WO2007/008038

PCT Pub. Date: Jan. 18, 2007

(65) Prior Publication Data

US 2009/0134154 A1 May 28, 2009

(30) Foreign Application Priority Data

Jul. 12, 2005 (KR) ..... 10-2005-0062954
Jul. 12, 2005 (KR) ..... 10-2005-0062956

(51) Int. Cl.
*H05B 6/64* (2006.01)

(52) U.S. Cl. ..... 219/738; 219/743; 219/756

(58) Field of Classification Search ..... 219/736–744, 219/756, 681–685
See application file for complete search history.

(56) References Cited

U.S. PATENT DOCUMENTS

| | | | | |
|---|---|---|---|---|
| 4,191,877 | A | 3/1980 | Tanaka et al. | 219/10.55 |
| 4,771,154 | A * | 9/1988 | Bell et al. | 219/685 |
| 6,448,540 | B1 * | 9/2002 | Braunisch et al. | 219/685 |
| 6,927,374 | B2 * | 8/2005 | Hu et al. | 219/742 |
| 2001/0045429 | A1 * | 11/2001 | Eke | 219/756 |
| 2003/0024925 | A1 * | 2/2003 | Graves et al. | 219/681 |

FOREIGN PATENT DOCUMENTS

| | | |
|---|---|---|
| CN | 1257985 | 6/2000 |
| CN | 2439631 | 7/2000 |
| JP | 04/242097 | 8/1992 |
| JP | 07/006873 | 1/1995 |

OTHER PUBLICATIONS

International Search Report dated Aug. 28, 2006.

* cited by examiner

*Primary Examiner* — Henry Yuen
*Assistant Examiner* — Jianying Atkisson
(74) *Attorney, Agent, or Firm* — KED & Associates, LLP

(57) ABSTRACT

The present invention relates to a device for preventing microwave leakage for a microwave oven. The present invention comprises a cavity assembly formed with an opening portion through which heating energy generated in an energy generating means is supplied into a cooking chamber provided within the cavity assembly; a cover provided on a side of the cavity assembly to cover the opening portion; and a choke member provided between the cavity assembly and the cover to prevent microwave supplied into the cooking chamber from leaking through a gap between the cavity assembly and the cover. According to the present invention, there is an advantage in that microwave is effectively prevented from leaking through a gap, which is formed when installing a heating means for providing a heating source in addition to the microwave.

15 Claims, 8 Drawing Sheets

【Figure 1】
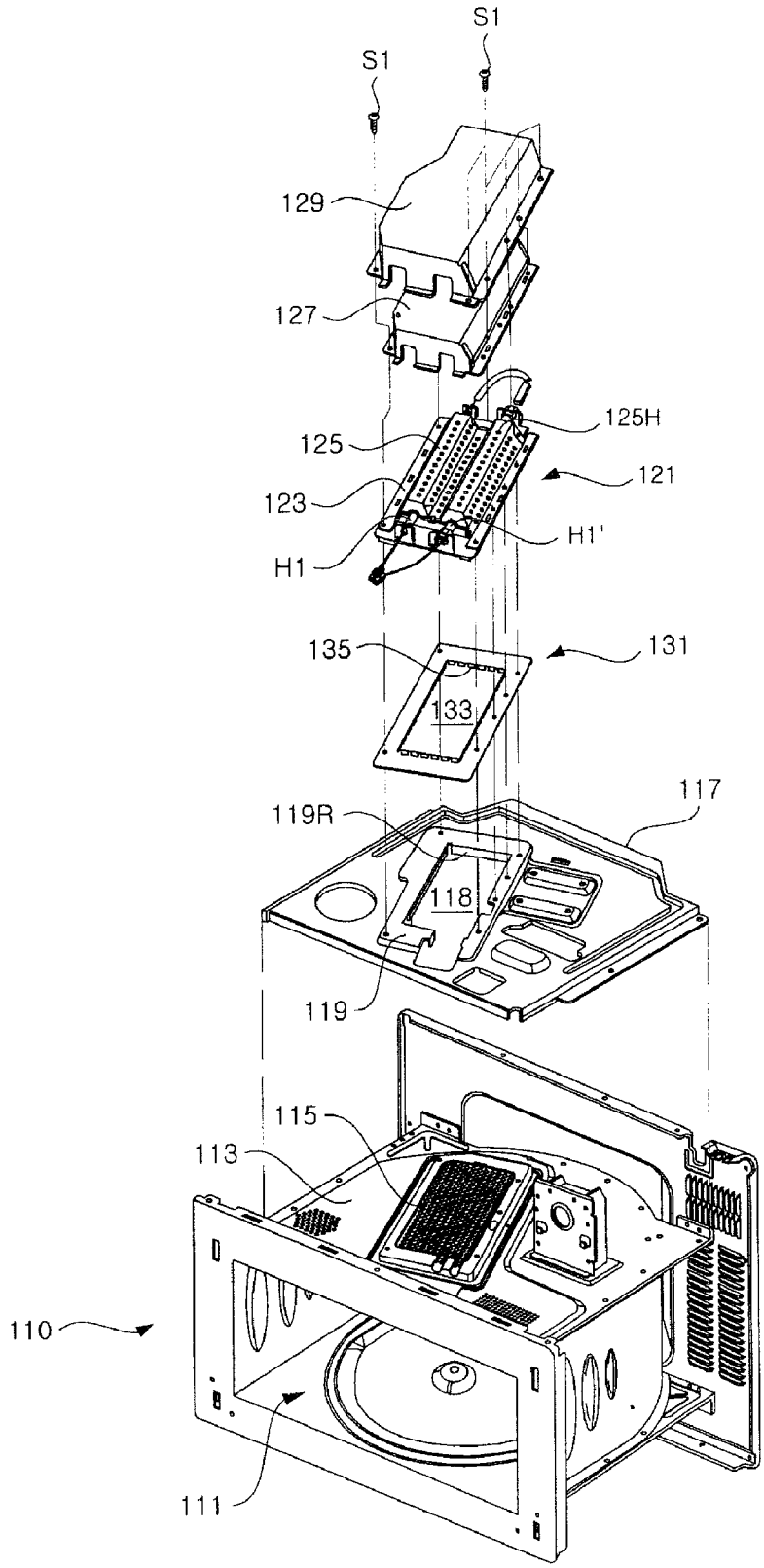

【Figure 2】
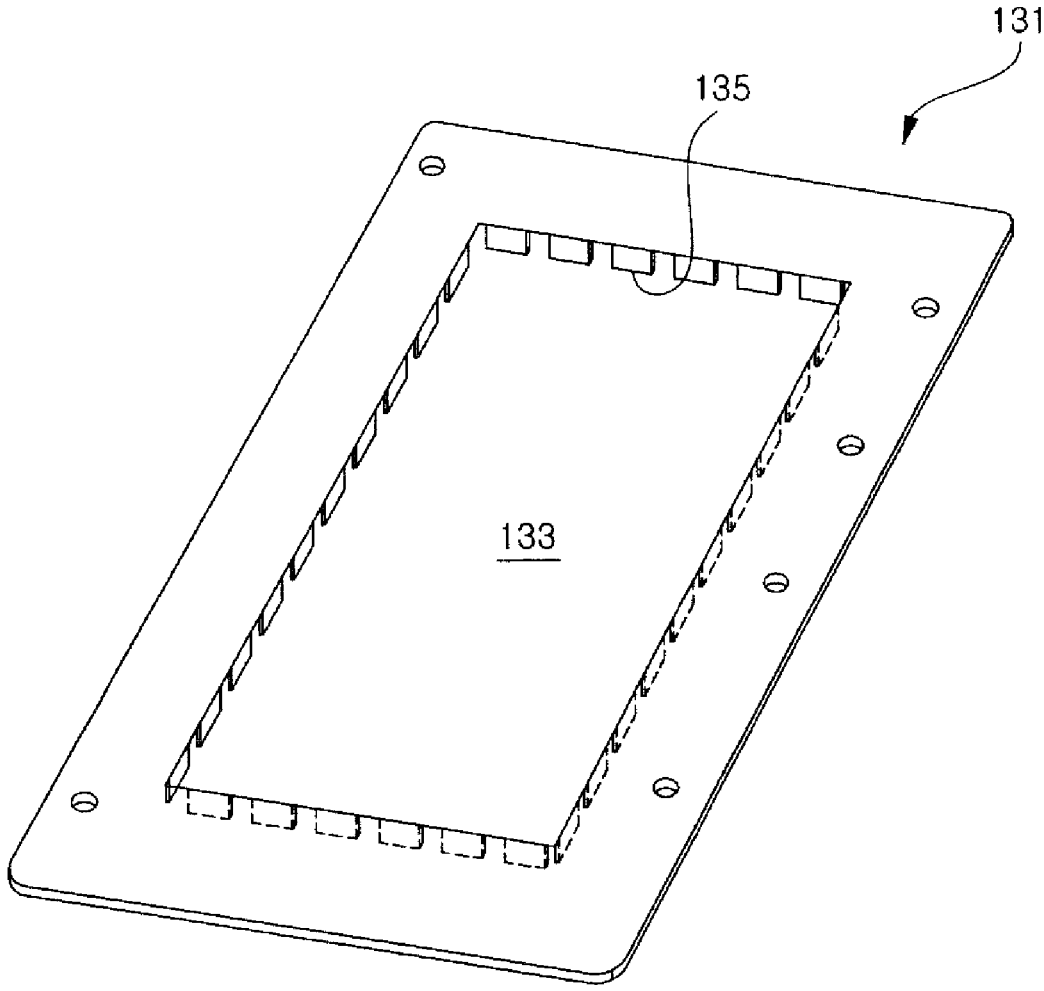

【Figure 3】
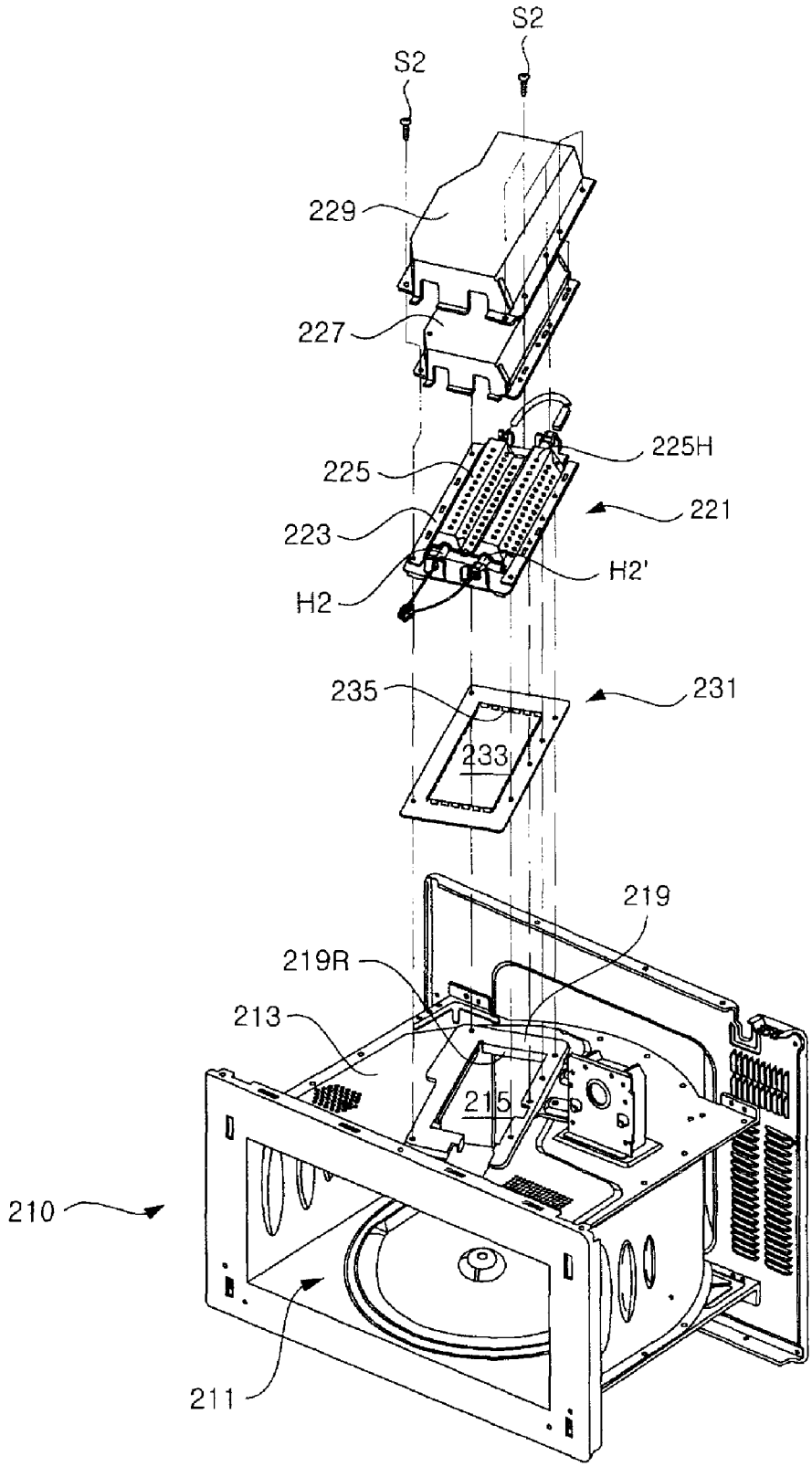

【Figure 4】
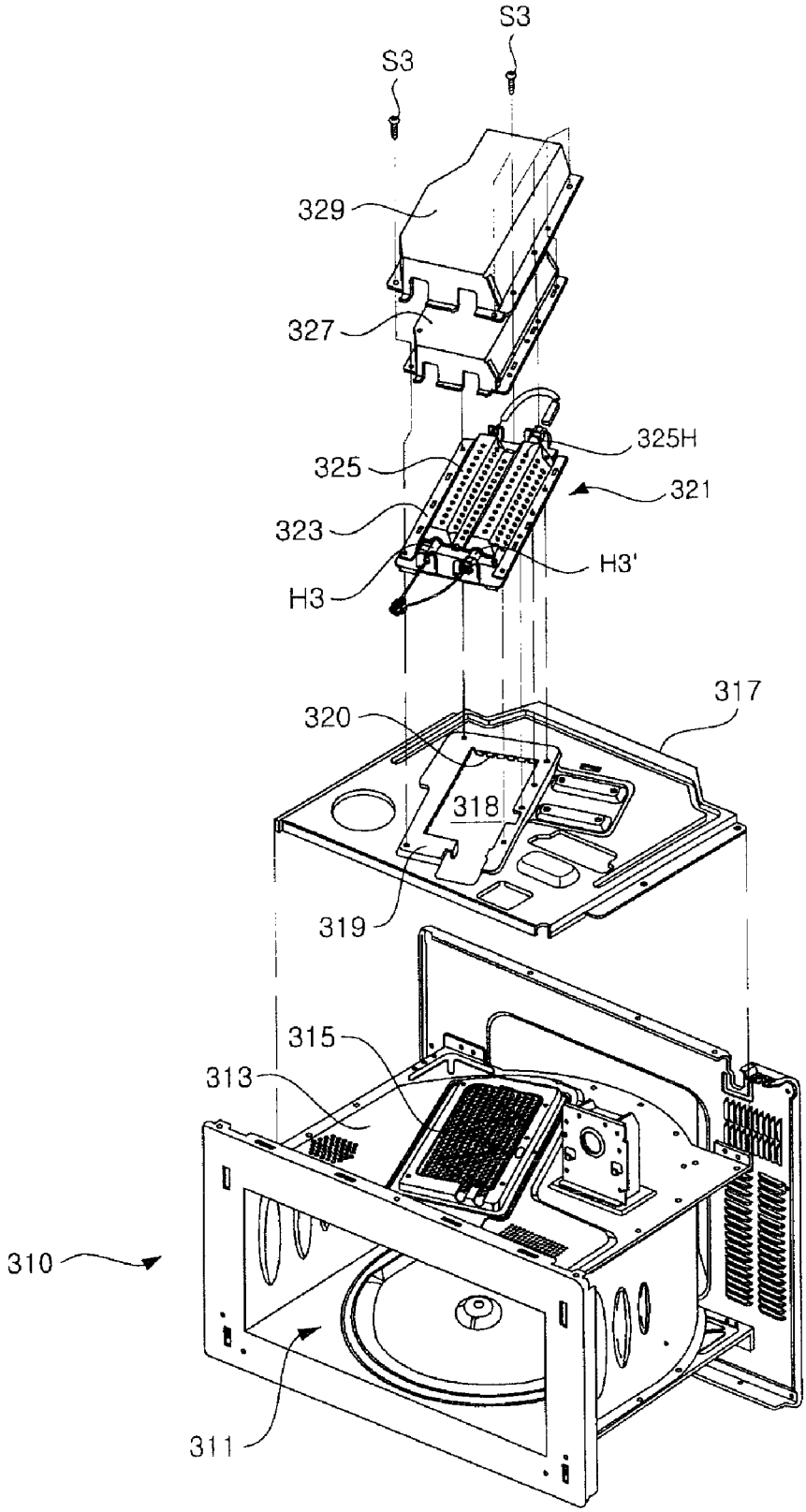

【Figure 5】
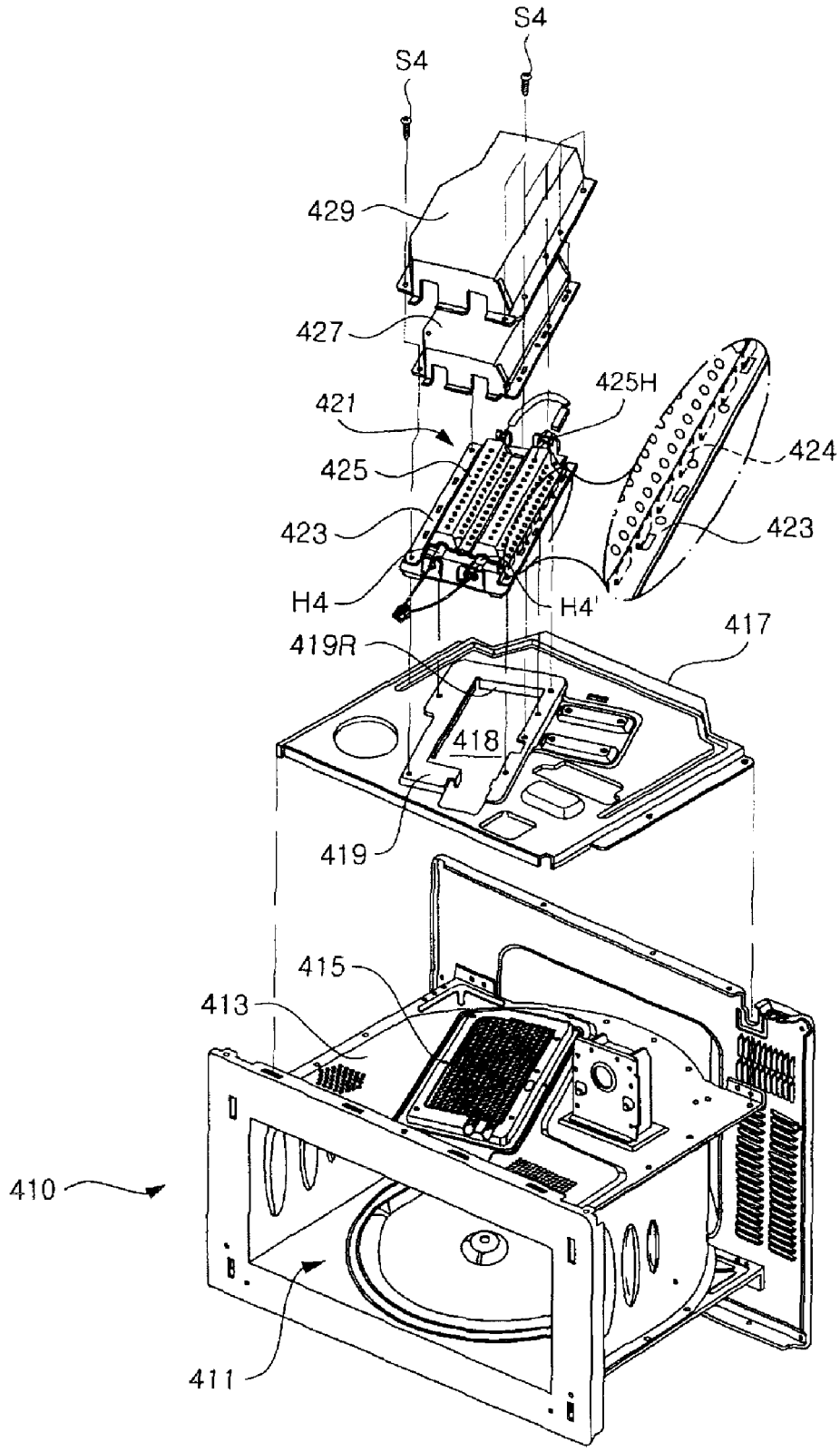

【Figure 6】
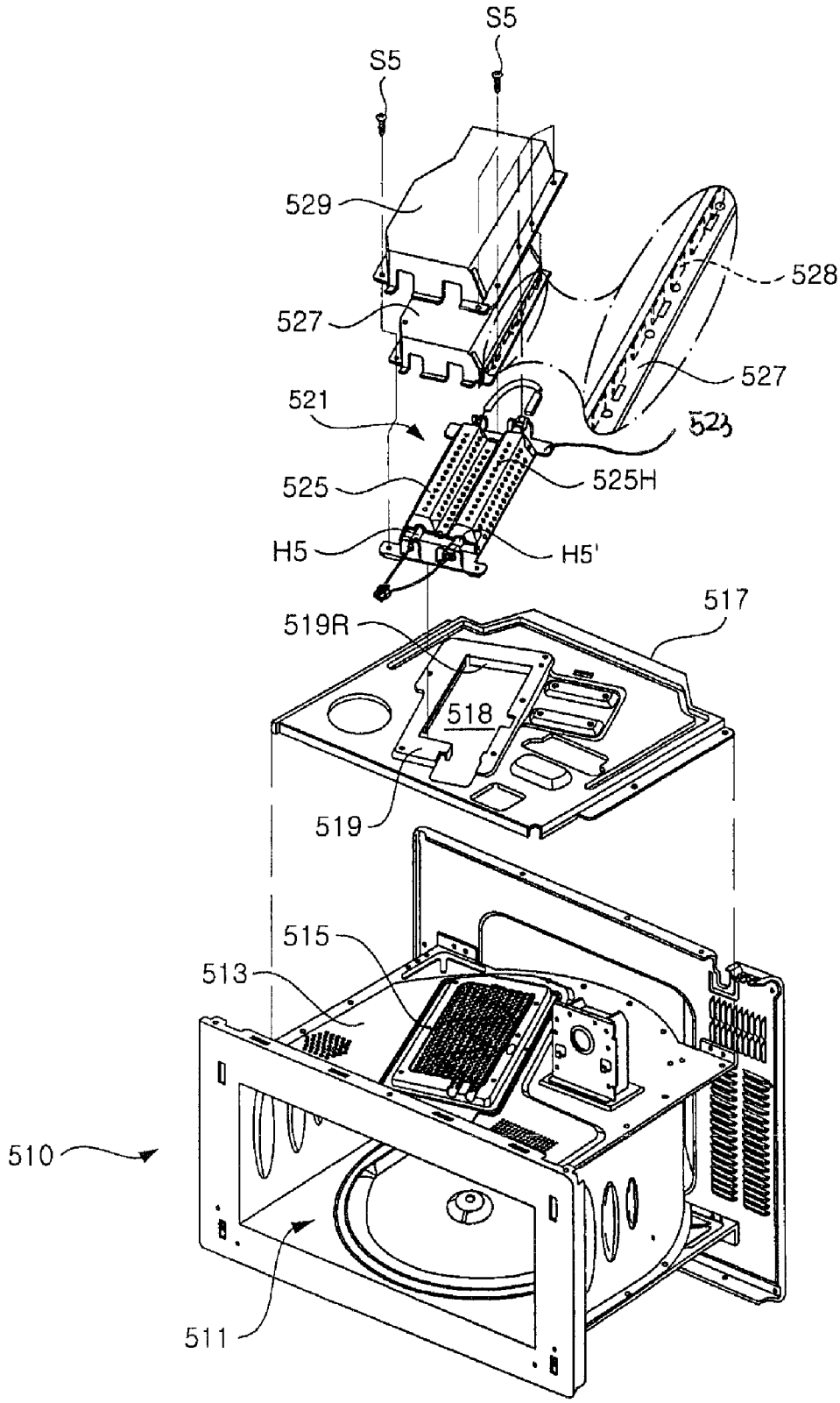

【Figure 7】
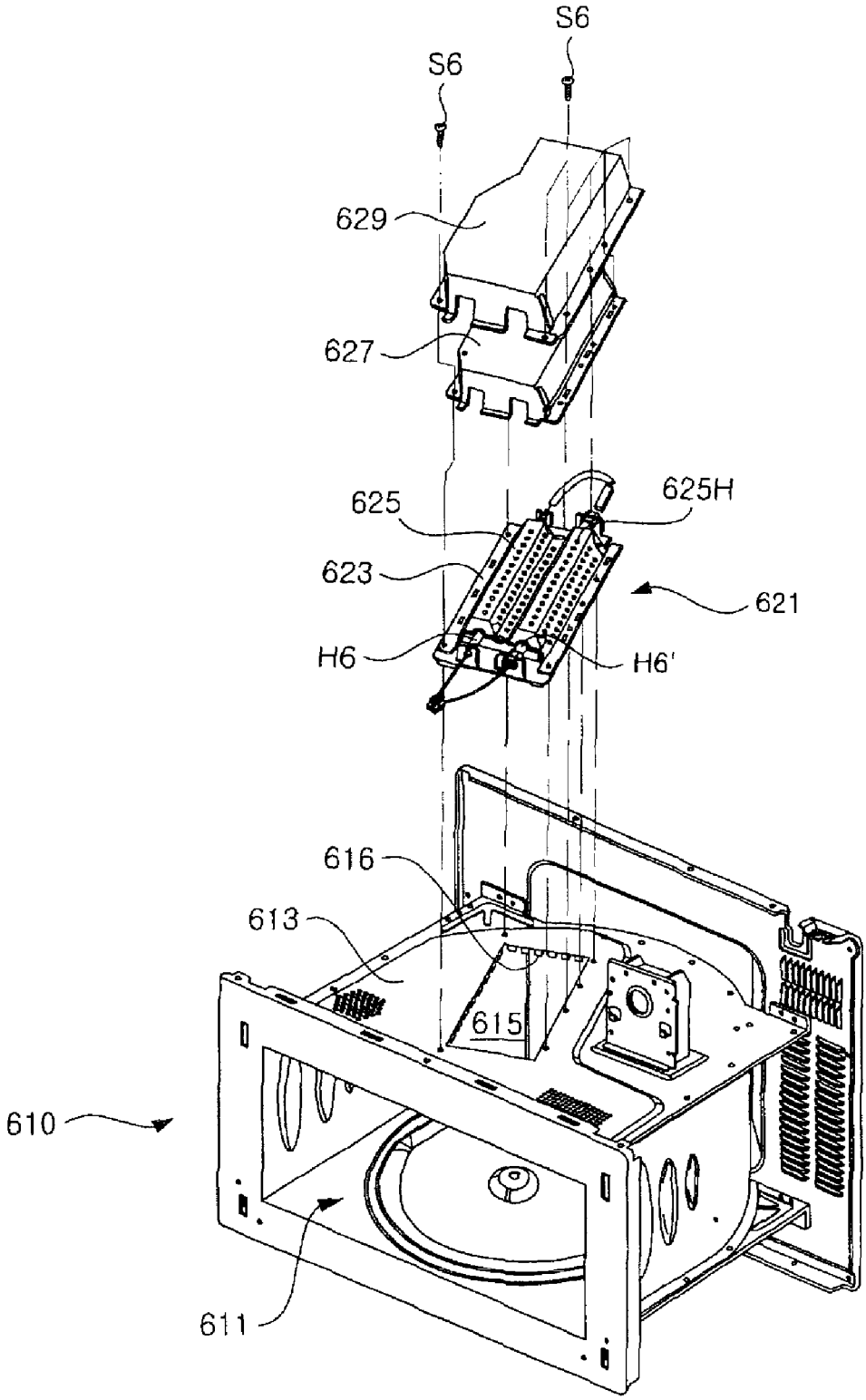

【Figure 8】
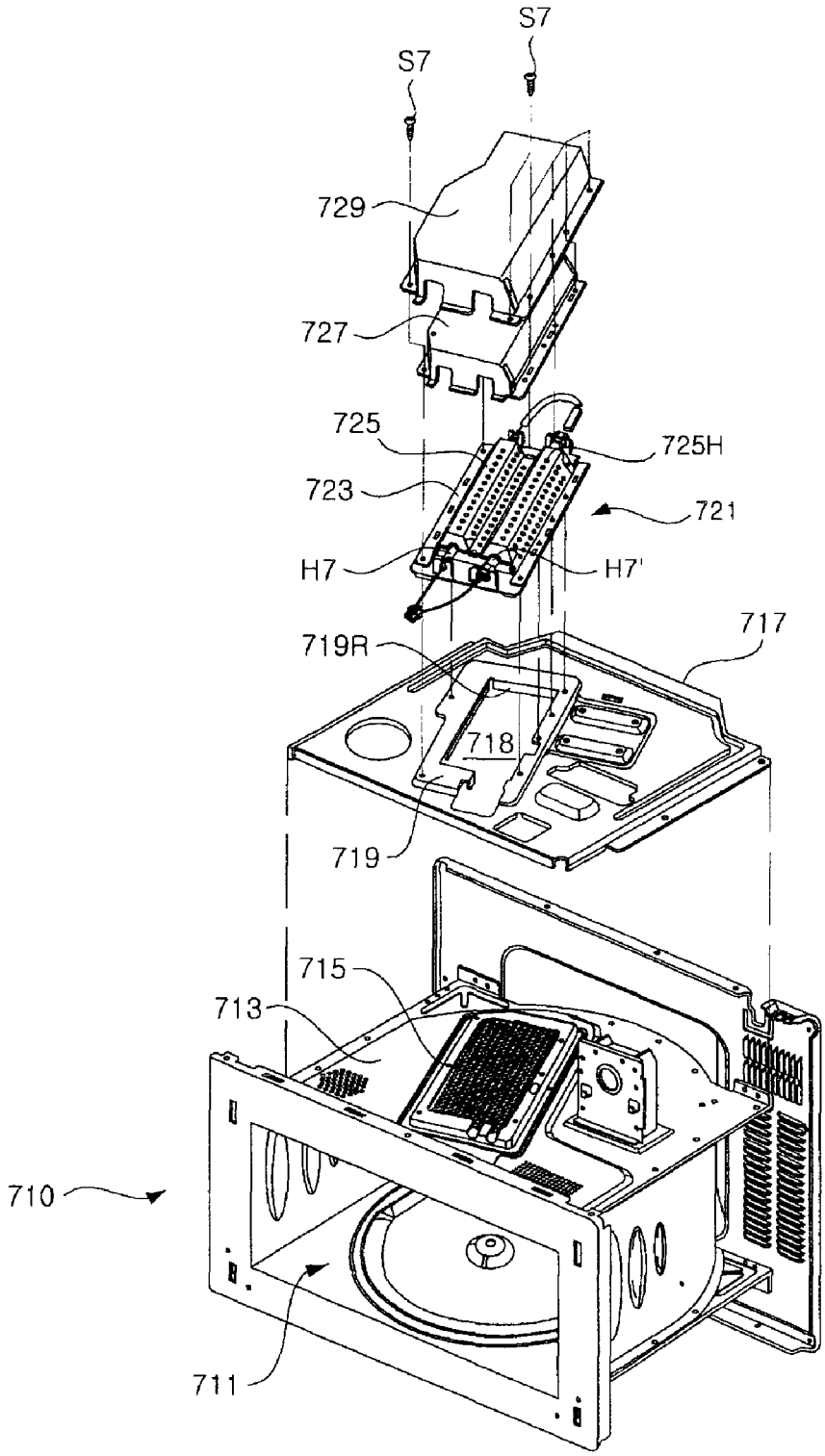

DEVICE FOR PREVENTING LEAKAGE OF MICROWAVE FOR MICROWAVE OVEN

TECHNICAL FIELD

The present invention relates to a microwave oven, and more particularly, to a device for preventing microwave leakage for a microwave oven capable of preventing microwave applied into a cooking chamber from leaking to the outside through the neighborhood of a porous portion in which a heater assembly is installed.

BACKGROUND ART

In general, a microwave oven is a cooking appliance for cooking food by applying microwave generated from a variety of electric parts into a cooking chamber. Recently, a microwave oven with a heater as a heating source in addition to microwave to cook a variety of foods has been launched.

FIG. 8 is an exploded perspective view showing a major portion of a microwave oven according to a prior art.

As shown in the figure, a cooking chamber 711 is provided within a cavity assembly 710 of the microwave oven. In addition, a porous portion 715 is provided in a side of an upper plate 713 of the cavity assembly 710 corresponding to the ceiling of the cooking chamber 711. The porous portion 715 is formed to have a plurality of holes bored through the upper plate 713 in the form of a generally rectangular shape.

In addition, an insulator 717 is installed on an upper surface of the upper plate 713. A heater opening portion 718 is formed in a portion of the insulator 717 corresponding to the porous portion 715. The heater opening portion 718 is a portion through which light and/or heat generated in a heater assembly 721 is supplied into the cooking chamber 711.

Also, a heater base 719 is provided on a portion of the insulator 717 corresponding to an inner peripheral portion of the heater opening portion 718. The heater base 719 is a portion to which the heater assembly 721 is fixed. The heater base 719 is shaped in a rectangular frame, and extension ribs 19R(=>719R) extending downward are provided on an inner peripheral portion of the heater base 719.

The heater base 719 is equipped with the heater assembly 721. The heater assembly 721 serves to heat food in the cooking chamber 711 by generating light and/or heat by applying power to the heater assembly 721. The heater assembly 721 is provided with a pair of heaters H7 and H7' for substantially generating light and/or heat. The heaters H7 and H7' may consist of, for example, a halogen heater and a ceramic heater.

The heaters H7 and H7' are respectively fixed to an upper surface of a heater supporter 723. The heater supporter 723, which is shaped in a rectangular frame, is fixed to the heater base 719 with the heaters H7 and H7' fixed to the upper surface of the heater supporter 723.

A reflecting plate 725 is provided above the heaters H7 and H7'. The reflecting plate 725 serves to reflect the light and/or heat of the heaters H7 and H7' toward the interior of the cooking chamber 711. The reflecting plate 725 is provided with a plurality of vents 725H. The vents 725H allow a portion of airflow generated from a cooling fan assembly (not shown) to be introduced through the vents to cool the heaters H7 and H7'.

In addition, a pair of shield covers 727 and 729 are provided above the reflecting plate 725. The shield covers 727 and 729 serve to prevent that microwave generated in electric parts and applied into the cooking chamber 711 leaks to the outside through the porous portion 715. Unexplained reference numeral S7 designates a screw for fixing the heater assembly 721 to the heater base 719.

However, the microwave oven according to the above prior art has the following problems.

In the prior art, there are provided a plurality of the shield covers 727 and 729 in order to prevent microwave applied into the cooking chamber 711 from leaking to the outside through the porous portion 715. However, there is a disadvantage in that only the shield covers 727 and 729 cannot sufficiently prevent the microwave from leaking through the porous portion 715.

DISCLOSURE

Technical Problem

The present invention is conceived to solve the aforementioned problems in the prior art. An object of the present invention is to provide a device for preventing microwave leakage for a microwave oven, which is configured to prevent microwave supplied into a cooking chamber from leaking.

Another object of the present invention is to provide a device for preventing microwave leakage for a microwave oven, which is configured to prevent microwave from leaking with a simple configuration.

Technical Solution

According to an aspect of the present invention for achieving the objects, there is provided a device for preventing microwave leakage for a microwave oven, comprising a cavity assembly formed with an opening portion through which heating energy generated in an energy generating means is supplied into a cooking chamber provided within the cavity assembly; a cover provided on a side of the cavity assembly to cover the opening portion; and a choke member provided between the cavity assembly and the cover to prevent microwave supplied into the cooking chamber from leaking through a gap between the cavity assembly and the cover.

According to another aspect of the present invention, there is provided a device for preventing microwave leakage for a microwave oven, comprising a cavity assembly provided with a cooking chamber therein and formed with an opening portion through which heating energy is supplied into the cooking chamber; an energy generating means installed on an upper portion of the opening portion and generating the heating energy supplied into the cooking chamber through the opening portion; and a choke member provided between a face of the cavity assembly and the energy generating means, the choke member preventing microwave applied into the cooking chamber from leaking to an outside through a gap between the cavity assembly and the energy generating means.

According to a further aspect of the present invention, there is provided a device for preventing microwave leakage for a microwave oven, comprising a cavity assembly provided with a cooking chamber therein and formed with a porous portion on an upper surface of the cavity assembly; an insulator installed on the upper surface of the cavity assembly and provided with an opening portion corresponding to the porous portion; an energy generating means installed on an upper portion of the opening portion and generating heating energy supplied into the cooking chamber through the opening portion and the porous portion; and a choke member provided between the insulator and the energy generating means, the choke member preventing microwave applied into the cooking chamber from leaking to an outside through a gap between the cavity assembly and the energy generating means.

Preferably, the energy generating means is a heater assembly including at least a heater for supplying light or heat supplied into the cooking chamber.

More preferably, the choke member is formed with a blank portion corresponding to the opening portion, and an inner peripheral portion of the blank portion is provided with a choke portion formed for a plurality of choke pieces and indented portions to be sequentially alternated at predetermined intervals.

According to a still further aspect of the present invention, there is provided a device for preventing microwave leakage for a microwave oven, comprising a cavity assembly provided with a cooking chamber therein, formed with a heater opening portion in a surface of the cavity assembly, and provided with a choke portion on an inner peripheral portion of the heater opening portion to prevent microwave supplied into the cooking chamber from leaking; and a heater assembly installed on an upper portion of the heater opening portion and generating heating energy supplied into the cooking chamber.

According to a still further aspect of the present invention, there is provided a device for preventing microwave leakage for a microwave oven, comprising a cavity assembly provided with a cooking chamber therein and formed with a porous portion on a surface of the cavity assembly; an insulator installed on the surface of the cavity assembly in which the porous portion is formed, formed with a heater opening portion corresponding to the porous portion, and provided with a choke portion on an inner peripheral portion of the heater opening portion to prevent microwave supplied into the cooking chamber from leaking; and a heater assembly installed on an upper portion of the heater opening portion and generating heating energy supplied into the cooking chamber.

Preferably, the inner peripheral portion of the heater opening portion is further provided with a heater base shaped in a rectangular frame to which the heater assembly is fixed, and the choke portion is installed to an inner peripheral portion of the heater base.

According to a still further aspect of the present invention, there is provided a device for preventing microwave leakage for a microwave oven, comprising a cavity assembly provided with a cooking chamber therein and formed with a heater opening portion on a surface of the cavity assembly, the heater opening portion communicating with the cooking chamber; and a heater assembly installed on an upper portion of the heater opening portion, generating heating energy supplied into the cooking chamber, and provided with a choke portion for preventing microwave supplied into the cooking chamber from leaking through a gap between the cavity assembly and the heater assembly.

Preferably, the heater assembly comprises at least a heater for generating light or heat, a heater supporter fixed to a surface of the cavity assembly with the heater fixed to the heater supporter, and a reflecting plate for reflecting the light or heat of the heater into the cooking chamber, and the choke portion is formed integrally with the heater supporter or the reflecting plate.

More preferably, the heater assembly comprises at least a heater for generating light or heat, a heater supporter fixed to a surface of the cavity assembly with the heater fixed to the heater supporter, a reflecting plate for reflecting the light or heat of the heater into the cooking chamber, and a covering member for covering the heater opening portion in addition to the heater, the heater supporter and the reflecting plate, and the choke portion is formed integrally with the covering member.

According to a still further aspect of the present invention, there is provided a device for preventing microwave leakage for a microwave oven, comprising a cavity assembly with a cooking chamber in which food is heated provided therein; a heater assembly formed on a side of the cavity assembly to supply light or heat for heating food into the cooking chamber through an opening portion communicating with the cooking chamber; and a leakage preventing means for preventing microwave from leaking through a gap between the cavity assembly and the heater assembly.

Preferably, the leakage preventing means is a choke member provided between the cavity assembly and the heater assembly and comprising a choke portion for preventing the microwave leakage which is formed for a plurality of choke pieces and indented portions to be sequentially alternated at predetermined intervals.

More preferably, the leakage preventing means is a choke portion installed to a heater base to which the heater assembly is fixed, the choke portion being formed for a plurality of choke pieces and indented portions to be sequentially alternated at predetermined intervals.

Still more preferably, the heater base is fixed to an insulator provided on a surface of the cavity assembly.

Still more preferably, the leakage preventing means is a choke portion installed to the heater assembly and formed for a plurality of choke pieces and indented portions to be sequentially alternated at predetermined intervals.

Still more preferably, the heater assembly comprises at least a heater for generating light or heat, a heater supporter fixed to a surface of the cavity assembly with the heater fixed to the heater supporter, a reflecting plate for reflecting the light or heat of the heater into the cooking chamber, and a covering member for covering the heater opening portion in addition to the heater, the heater supporter and the reflecting plate, and the choke portion is installed to any one of the heater supporter, the reflecting plate and the covering member and formed for a plurality of choke pieces and indented portions to be sequentially alternated at predetermined intervals.

Advantageous Effects

According to a device for preventing microwave leakage for a microwave oven of the present invention, the following advantages can be expected.

According to the present invention, in order to prevent microwave supplied into a cooking chamber from leaking through a gap between a cavity assembly and a heater assembly, a choke member with a choke portion is provided between the cavity assembly and the heater assembly. Therefore, it is possible to more ensure the stability of a microwave oven using microwave as a primary heating source, thereby increasing the reliability of the manufactures.

Further, in the present invention, the choke portion is not provided in the separate choke member, but may be formed integrally with any one of components of the cavity assembly or heater assembly. Therefore, with a simpler configuration, it is possible to prevent microwave from leaking to the outside of the cooking chamber and at the same time to reduce the man-hour needed for the works and the production costs for the manufactures.

DESCRIPTION OF DRAWINGS

FIG. 1 is an exploded perspective view showing a major portion of a microwave oven having a first embodiment of a device for preventing microwave leakage according to the present invention;

FIG. 2 is a perspective view showing a choke member of the first embodiment according to the present invention;

FIG. 3 is an exploded perspective view showing a major portion of a microwave oven having a second embodiment of a device for preventing microwave leakage according to the present invention;

FIG. 4 is an exploded perspective view showing a major portion of a microwave oven having a third embodiment of a device for preventing microwave leakage according to the present invention;

FIG. 5 is an exploded perspective view showing a major portion of a microwave oven having a fourth embodiment of a device for preventing microwave leakage according to the present invention;

FIG. 6 is an exploded perspective view showing a major portion of a microwave oven having a fifth embodiment of a device for preventing microwave leakage according to the present invention;

FIG. 7 is an exploded perspective view showing a major portion of a microwave oven having a sixth embodiment of a device for preventing microwave leakage according to the present invention; and FIG. 8 is an exploded perspective view showing a major portion of a microwave oven according to a prior art.

BEST MODEL

Hereinafter, a preferred embodiment of a device for preventing microwave leakage for a microwave oven according to the present invention will be described in detail with reference to the accompanying drawings.

FIG. 1 is an exploded perspective view showing a major portion of a microwave oven having a first embodiment of a device for preventing microwave leakage according to the present invention, and FIG. 2 is a perspective view showing a choke member of the first embodiment according to the present invention.

As shown in the figures, a cooking chamber 111 selectively opened and closed by a door (not shown) is provided within a cavity assembly 110 of a microwave oven. A porous portion 115 is also provided in an upper plate 113 of the cavity assembly 110 to have a plurality of holes bored through the upper plate 113 in the form of a generally rectangular shape.

The porous portion 115 allows light and/or heat of a heater assembly 121, which will be described below, to be supplied into the cooking chamber 111 through the porous portion 115. At this time, in consideration of a wavelength and the like of microwave supplied into the cooking chamber 111, the respective holes of the porous portion 115 are designed to have a diameter to prevent microwave from leaking to the outside.

An insulator 117 is installed to the upper plate 113 of the cavity assembly 110. A heater opening portion 118 is formed in a portion of the insulator 117, i.e., a portion corresponding to the porous portion 115. The heater opening portion 118 is a portion through which light and/or heat generated in a heater assembly 121 is supplied into the cooking chamber 111. The heater opening portion 118 is formed in a rectangular shape corresponding to the porous portion 115.

In addition, a heater base 119 is provided on a portion of the upper plate 113 corresponding to the heater opening portion 118. The heater base 119 is to install the heater assembly 121. The heater base 119 is shaped in a rectangular frame. Also, extension ribs 119R extending downward by a predetermined length are provided on an inner peripheral portion of the heater base 119.

The heater base 119 is equipped with the heater assembly 121. The heater assembly 121 generates a predetermined energy as a heating source in addition to microwave. For example, the heater assembly 121 is provided with a heater, a lamp or the like for generating light and/or heat by applying power thereto, and the light and/or heat acts as a heating source for heating food loaded in the cooking chamber 111. In the present invention, the heater assembly 121 is used to intend to include all means for generating energy capable of heating food except microwave.

The heater assembly 121 is provided with heaters H1 and H1' for generating light and/or heat by applying power thereto. In the present invention, as the heater H1 or H1', any type of heater such as a halogen lamp or a ceramic heater may be used if it generates light or heat by applying power thereto. The heaters H1 and H1' are fixed to an upper surface of a heater supporter 123 shaped in a rectangular frame. The heater supporter 123 is installed to an upper surface of the insulator 117 adjacent to the heater opening portion 118, with the heaters H1 and H1' fixed to the upper surface of the heater supporter 123.

A reflecting plate 125 is provided above the heaters H1 and H1'. The reflecting plate 125, which is installed so as to enclose the heaters H1 and H1' from their top, serves to reflect light and/or heat generated in the heaters H1 and H1' into the cooking chamber 111 through the heater opening portion 118 and the porous portion 115. In addition, the reflecting plate 125 is formed with a plurality of vents 125H for cooling the heaters H1 and H1'.

The porous portion 115 simultaneously performs the function of allowing the light and heat generated in the heater to pass into the cooking chamber 111 and the function of preventing the microwave supplied into the cooking chamber from leaking to the outside. That is, by designing the circular holes of the porous portion 115 to be proper in size, the microwave having a predetermined wavelength is prevented from leaking. Such a configuration itself of the porous portion is applied to a door or the like of a microwave oven. Also, the microwave leaking from the porous portion 115 is more securely blocked by a choke member 131 of the present invention as described below.

In addition, a pair of shield covers 127 and 129 are installed above the reflecting plate 125. The shield covers 127 and 129 prevent leakage of microwave applied into the cooking chamber 111 through the porous portion 115 and the heater opening portion 118.

In the meantime, the choke member 131 is provided between the insulator 117 and the heater assembly 121. The choke member 131 is installed on the heater base 119 of the insulator 117, and thus prevents microwave applied into the cooking chamber 111 from leaking to the outside through a gap between the heater assembly 121 and the heater base 119, i.e., the heater opening portion 118.

As shown in FIG. 2 in detail, the choke member 131 is formed in a rectangular shape for covering the heater opening portion 118. A blank portion 133 is formed in the choke member 131. The blank portion 133 allows light and/or heat generated in the heaters H1 and H1' to be supplied into the cooking chamber 111.

The blank portion 133 is formed in a shape and size corresponding to the heater opening portion 118. Also, a choke portion 135 is provided on an inner peripheral portion of the blank portion 133. The choke portion 135 extends downward from the inner peripheral portion of the blank portion 133. When the choke member 131 is coupled to the heater base 119, the choke portion 135 is inserted into the opening portion 118 of the heater base 119 and positioned adjacent to the extension ribs 119R.

The choke portion 135 is formed to comprise rectangle-shaped protruding portions (choke pieces) and indented portions which are sequentially alternated at predetermined intervals on the inner peripheral portion of the blank portion 133. The prevention of the microwave leakage by the choke portion 135 has already been known, and thus the detailed descriptions thereof will be omitted.

The size of the choke pieces applied to the door and the interval therebetween are determined depending on a wavelength of microwave and a size of the opened portions. In general, the choke pieces are designed so that a width of the choke piece is about 12.0 mm and an interval between the choke pieces is 7.0 to 8.0 mm. The longer the choke piece, the more effective the prevention of the microwave leakage. However, the choke piece is generally designed to be 6.5 mm or so.

Therefore, in the present embodiment, in consideration of the shape and size of the heater opening portion 118, the choke portion 135 will be designed. Also, it is natural that the microwave leakage can be substantially prevented by the shape, size and the like of the choke pieces and indented portions of the choke portion 135. However, since the extension ribs 119R are provided on the inner peripheral portion of the heater base 119 to extend downward, the choke portion 135 will be designed to be longer than the extension ribs 119R.

Also, in the present embodiment, the choke member 133 is provided between the heater base 119 and the heater assembly 121 so that the choke portion 135 is directed downward. However, the choke member 133 may be installed so that the choke portion 135 is directed upward by rotating 180 degrees from a state shown in FIGS. 1 and 2.

Hereinafter, the operation of the first embodiment of the device for preventing the microwave leakage for a microwave oven according to the present invention so configured will be described in detail.

First, the insulator 117 in which the heater base 119 is previously installed is mounted to the upper plate 113 of the cavity assembly 110. At this time, during the installation of the insulator 117, the porous portion 115 of the upper plate 113 and the heater opening portion 118 of the insulator 117 are positioned corresponding to each other.

In such a state, the choke member 131 is fixed to the insulator 117, substantially to the heater base 119. At this time, the choke member 131 is fixed to the insulator 117 so that the choke portion 135 of the choke member 131 is positioned in the region of the porous portion 115 and the heater opening portion 118.

Then, the heater supporter 123 to which the heaters H1 and H1' and the reflecting plate 125 are previously assembled is positioned on the heater base 119 on the portion corresponding to the heater opening portion 118. Then, the shield covers 127 and 129, the reflecting plate 125, the choke member 131, the insulator 117, and the upper plate 113 of the cavity assembly 110 are fastened to each other using screws S1, thereby completing the assembly.

In the meantime, when completing the assembly, the choke portion 135 capable of preventing the microwave leakage is provided on the inside surface of the heater opening portion 118. Thus, during a process of cooking food in the cooking chamber 111 using microwave, it is possible for the choke portion 135 of the choke member 131 to securely prevent microwave from leaking through a gap between the heater opening portion 118 and the heater assembly 121.

MODE FOR INVENTION

Hereinafter, a second embodiment of a device for preventing microwave leakage according to the present invention will be described in detail with reference to the accompanying drawing.

FIG. 3 is an exploded perspective view showing a major portion of a microwave oven having the second embodiment of the device for preventing microwave leakage according to the present invention.

As shown in the figure, an upper plate 213 of a cavity assembly 210 which is provided with a cooking chamber 211 for cooking food is formed with a heater opening portion 215. In addition, a portion of the upper plate 213 corresponding to an inner peripheral portion of the heater opening portion 215 is provided with a heater base 219.

The heater base 219 is equipped with a heater assembly 211(=>221). In the present embodiment, the configuration of the heater assembly 211(=>221), i.e., heaters H2 and H2', a heater supporter 223, a reflecting plate 225, and shield covers 227 and 229, is identical to that of the aforementioned first embodiment. The heater assembly 211(=>221) is fixed with screws S2.

In the meantime, a choke member 231 is provided between the upper plate 213 and the heater assembly 211, substantially between the heater base 219 and the heater assembly 211. The choke member 231, which is identical to that of the first embodiment, serves to prevent leakage of the microwave applied to the cooking chamber 211. That is, the choke member 231 is formed with a blank portion 233 corresponding to the opening portion 215. In addition, a choke portion 235 extends downward from an inner peripheral portion of the blank portion 233.

That is, as compared with the aforementioned first embodiment, a porous portion and an insulator are omitted in the present embodiment. Thus, the heater base 219 is fixed to the upper plate 213 contrary to the first embodiment in which the heater base is provided in the insulator, and the heater opening portion 215 is formed in the upper plate 213 contrary to the first embodiment in which the heater opening portion is formed in the insulator. Further, the choke member 231 is provided between the heater assembly 211 and the heater base 219 provided in the upper plate 213.

Next, a third embodiment of a device for preventing microwave leakage according to the present invention will be described in detail with reference to the accompanying drawing.

FIG. 4 is an exploded perspective view showing a major portion of a microwave oven having the third embodiment of the device for preventing microwave leakage according to the present invention.

As shown in the figure, a cooking chamber 311 selectively opened and closed by a door (not shown) is provided within a cavity assembly 310 of the microwave oven. Also, an upper plate 313 of the cavity assembly 310 is formed with a porous portion 315 in which a plurality of holes are formed. The porous portion 315 allows light and/or heat of a heater assembly 321, which will be described below, to be supplied into the cooking chamber 311 through the porous portion 315.

The upper plate 313 is equipped with an insulator 317. A heater opening portion 318 is formed in a side of the insulator 317. The heater opening portion 318 is positioned corresponding to the porous portion 315, with the insulator 317 installed to the upper plate 313. Thus, the light and/or heat of the heater assembly 321 is supplied into the cooking chamber 311 through the porous portion 315 and the heater opening portion 318.

A heater base 319 is installed to a portion of the insulator 317 corresponding to an inner peripheral portion of the heater opening portion 318. The heater base 319 is a portion to which the heater assembly 321 is substantially installed. In addition, a choke portion 320 is provided on an inner peripheral portion of the heater base 319. The choke portion 320 is formed in the same shape as the aforementioned first embodiment, and thus, serves to prevent microwave applied into the cooking chamber 311 from leaking through a gap between the heater base 319 and the heater assembly 321.

That is, in the present embodiment, the choke portion 320 is formed on not a additional member but the heater base 319. Therefore, according to the present embodiment, contrary to the aforementioned first embodiment, there is provided no additional choke member provided with the choke portion 320, whereby with a simpler configuration, microwave applied into the cooking chamber 311 can be prevented from leaking through the gap between the heater base 319 and the heater assembly 321.

In addition, the heater base 319 is provided with the heater assembly 321. The heater assembly 321, which supplies light and/or heat into the cooking chamber 311 through the heater opening portion 318 and the porous portion 315, comprises heater H3 and H3', a heater supporter 323, a reflecting plate 325, and a shield cover 327 329, which are identical to those of the aforementioned first embodiment, and of which the descriptions will thus be omitted.

A fourth embodiment of a device for preventing microwave leakage according to the present invention will be described in detail with reference to the accompanying drawing.

FIG. 5 is an exploded perspective view showing a major portion of a microwave oven having the fourth embodiment of the device for preventing microwave leakage according to the present invention.

As shown in the figure, a cooking chamber 411 is provided within a cavity assembly 410 of the microwave oven. In addition, a porous portion 415 is provided in a side of an upper plate 413 of the cavity assembly 410 corresponding to the ceiling of the cooking chamber 411. Also, an insulator 417 is installed on an upper surface of the upper plate 413, and a heater opening portion 418 is formed in a side of the insulator 417. Further, the insulator 417 is provided with a heater base 419 which is provided with extension ribs 419R extending downward from an inner peripheral portion of the heater base 419.

The heater base 419 is equipped with a heater assembly 421. The heater assembly 421 includes a pair of heaters H4 and H4', a heater supporter 423, a reflecting plate 425, and shield covers 427 and 429. Since such a configuration of the present embodiment is identical to that of the aforementioned first embodiment, the detailed descriptions thereof will be omitted.

However, in the present embodiment, a choke portion 424, which prevents microwave applied into the cooking chamber 411 for heating food from leaking through a gap between the heater base 419 and the heater assembly 421, is provided on a bottom surface of an edge of the heater supporter 423.

That is, the choke portion 424 is formed such that rectangle-shaped choke pieces extending downward from an inner peripheral portion of the heater supporter 424 and indented portions are sequentially alternated at predetermined intervals. Therefore, the choke portion 424 is positioned within the heater opening portion 418. The shape and size of the choke portion 424 will be determined to more effectively prevent microwave leakage depending on the shape and size of the heater opening portion 418.

In other words, in the present embodiment, since the choke portion 424 is formed integrally with the heater supporter 423, there is no need for an additional member in which the choke portion is provided as in the aforementioned third embodiment. Thus, with a simpler configuration, microwave applied into the cooking chamber 411 can be prevented from leaking.

A fifth embodiment of a device for preventing microwave leakage for a microwave oven according to the present invention will be described in detail with reference to the accompanying drawing.

FIG. 6 is an exploded perspective view showing a major portion of a microwave oven having the fifth embodiment of the device for preventing microwave leakage according to the present invention;

As shown in the figure, in the present embodiment, a cooking chamber 511 is provided within a cavity assembly 510, and a porous portion 515 is provided in a side of an upper plate 513 of the cavity assembly 510. Also, an insulator 517 formed with a heater opening portion 518 is installed on an upper surface of the upper plate 513. In addition, the insulator 517 is provided with a heater base 519 for fixing a heater assembly 521.

In the meantime, the heater assembly 521 comprises a pair of heaters H5 and H5', a heater supporter 523, a reflecting plate 525, and shield covers 527 and 529. In the present embodiment, the heater supporter 523 is generally formed in an "I" shape. It is for the purpose of allowing a choke portion 528, which will be described below, to pass through the heater supporter 523 and to be positioned within the heater opening portion 518. Therefore, the heater supporter 523 may be shaped in a rectangular frame as in a prior art, and a slot for allowing the choke portion 528 to passes therethrough may be formed in the reflecting plate 525.

Further, in the present embodiment, the shield cover 527 which is positioned relatively lower among the shield covers 527 and 529 is provided with the choke portion 528. The choke portion 528 serves to prevent the microwave applied into the cooking chamber 511 for heating food from leaking to the outside through a gap between the heater base 519 and the heater assembly 521. The choke portion 528 extends downward from a bottom surface of an edge of the shield cover 527, passes through both sides of the heater supporter 523, and is positioned within the heater opening portion 518.

That is, in the present embodiment, the choke portion 528 is formed integrally with the shield cover 527. Thus, as in the aforementioned third and fourth embodiments, with a simpler configuration, the microwave applied into the cooking chamber 511 can be prevented from leaking.

A sixth embodiment of a device for preventing microwave leakage for a microwave oven according to the present invention will be described in detail with reference to the accompanying drawing.

FIG. 7 is an exploded perspective view showing a major portion of a microwave oven having the sixth embodiment of the device for preventing microwave leakage according to the present invention.

As shown in the figure, a cooking chamber 611 is provided within a cavity assembly 610 of the microwave oven. The cooking chamber 611, in which food is heated, is selectively opened and closed by a door (not shown). In addition, an upper plate 613 of the cavity assembly 610 is formed with a heater opening portion 615. The heater opening portion 615 is formed by having a portion of the upper plate 613 to be cut in a rectangular shape.

In the present embodiment, a choke portion 616 is provided on an inner peripheral portion of the heater opening portion 615. The choke portion 616 serves to prevent microwave applied into the cooking chamber 611 from leaking to the outside through a gap between the heater opening portion 615 and a heater assembly 621 that will be described below. The choke portion 616 may be substantially formed integrally with the upper plate 613. That is, in a process of cutting a portion of the upper plate 613 in order to form the heater opening portion 615, portions of the upper plate 613 corresponding to an inner peripheral portion of the heater opening portion 615 are cut so that rectangle-shaped choke pieces and indented portions are alternated, and the choke pieces are then bent downward to be perpendicular to the upper plate 613, whereby the choke portion 616 is formed.

In the meantime, the upper plate 613 is provided with the heater assembly 621. The heater assembly 621 substantially supplies light and/or heat for heating food into the cooking chamber 611. Here, the configuration of the heater assembly 621 comprising heaters H6 and H6', a heater supporter 623, a reflecting plate 625, and shield covers 627 and 629 is identical to that of the aforementioned first embodiment, so that the detailed descriptions thereof will be omitted.

As in the aforementioned third to fifth embodiments, an additional member provided with the choke portion may also be omitted in the present embodiment. That is, according to the present embodiment, the choke portion 616 is formed integrally with the upper plate 613, whereby it is possible to simply prevent the microwave leakage.

The scope of the present invention is not limited to the embodiments described above but is defined by the claims. It will be apparent that those skilled in the art can make various modifications and changes thereto within the scope of the invention defined by the claims.

The invention claimed is:

1. A device for preventing microwave leakage for a microwave oven, the device comprising:
- a cavity assembly having an opening portion formed therein through which heating energy generated by an energy generator is supplied into a cooking chamber provided within the cavity assembly;
- a cover provided on a side of the cavity assembly to cover the opening portion;
- a choke member provided between the cavity assembly and the cover to prevent microwaves supplied into the cooking chamber from leaking through a gap between the cavity assembly and the cover, wherein the choke member comprises:
  - an open section corresponding to the opening portion of the cavity assembly; and
  - a choke section surrounding the open section, wherein the choke section comprises a choke portion including a plurality of choke pieces that each protrude from an inner peripheral edge of the choke section, and a plurality of indented sections, wherein the plurality of choke pieces and the plurality of indented sections are sequentially alternated at predetermined intervals along the inner peripheral edge of the choke section corresponding to an outer peripheral edge of the open section; and
- an insulator installed on an upper surface of the cavity assembly, the insulator comprising:
  - an opening formed therein corresponding to the opening portion of the cavity assembly; and
  - extension ribs extending downward along a peripheral edge of the opening, wherein the choke section is inserted into the opening formed in the insulator and positioned adjacent to the extension ribs.

2. A device for preventing microwave leakage for a microwave oven, the device comprising:
- a cavity assembly having a cooking chamber formed therein and an opening portion that directs heating energy into the cooking chamber;
- an energy generator installed on an upper portion of the opening portion so as to generate heating energy to be directed into the cooking chamber through the opening portion;
- a choke member provided between a face of the cavity assembly and the energy generator so as to prevent microwaves supplied into the cooking chamber from leaking to an outside through a gap between the cavity assembly and the energy generator, wherein the choke member comprises:
  - an open section corresponding to the opening portion of the cavity assembly; and
  - a choke section surrounding the open section, wherein the choke section comprises a choke portion including a plurality of choke pieces that each protrude from an inner peripheral edge of the choke section, and a plurality of indented sections, wherein the plurality of choke pieces and the plurality of indented sections are sequentially alternated at predetermined intervals along the inner peripheral edge of the choke section corresponding to an outer peripheral edge of the open section; and
- an insulator installed on the face of the cavity assembly, the insulator comprising:
  - an opening formed therein corresponding to the opening portion of the cavity assembly; and
  - extension ribs extending downward along a peripheral edge of the opening, wherein the choke section is inserted into the opening formed in the insulator and positioned adjacent to the extension ribs.

3. A device for preventing microwave leakage for a microwave oven, the device comprising:
- a cavity assembly having a cooking chamber formed therein;
- a porous portion provided on an upper surface of the cavity assembly;
- an insulator installed on the upper surface of the cavity assembly, the insulator including an opening portion corresponding to the porous portion, and extension ribs extending downward from a periphery of the opening portion;
- an energy generator installed on an upper portion of the opening portion so as to generate heating energy to be supplied into the cooking chamber through the opening portion and the porous portion; and
- a choke member provided between the insulator and the energy generator so as to prevent microwaves supplied into the cooking chamber from leaking to an outside through a gap between the cavity assembly and the energy generator, wherein the choke member comprises:
  - an open section corresponding to the opening portion of the cavity assembly; and
  - a choke section surrounding the open section, wherein the choke section comprises a choke portion including a plurality of choke pieces that each protrude from an inner peripheral edge of the choke section, and a plurality of indented sections, wherein the plurality of choke pieces and the plurality of indented sections are sequentially alternated at predetermined intervals along the inner peripheral edge of the choke section corresponding to an outer peripheral edge of the open section, wherein the choke section is inserted into the opening portion of the insulator, with an outer periphery of the choke section positioned adjacent to the extension ribs of the insulator.

4. The device as claimed in any one of claim 1, 2 or 3, wherein the energy generator comprises a heater assembly including at least a heater or lamp that generates light or heat to be supplied into the cooking chamber.

5. A device for preventing microwave leakage for a microwave oven, the device comprising:

a cavity assembly having a cooking chamber formed therein, including a heater opening portion formed in a surface of the cavity assembly;

an insulator installed on the surface of the cavity assembly, the insulator comprising:

an opening formed therein corresponding to the heater opening portion of the cavity assembly; and extension ribs extending downward along a peripheral edge of the opening;

a heater base having a rectangular frame shape, wherein the heater base is positioned within an outer peripheral edge of the heater opening portion and corresponding to the opening in the insulator;

a choke portion provided along an inner peripheral edge of the heater base, with an outer peripheral edge thereof positioned adjacent to the extension ribs of the insulator, so as to prevent microwaves supplied into the cooking chamber from leaking, wherein the choke portion comprises a plurality of choke pieces that extend from the inner peripheral edge of the heater base and a plurality of indented sections, wherein the plurality of choke pieces and plurality of indented sections are arranged in a sequential alternating pattern at predetermined intervals along the inner peripheral edge of the heater base; and a heater assembly installed on an upper portion of the heater opening portion so as to generate heating energy to be supplied into the cooking chamber.

6. A device for preventing microwave leakage for a microwave oven, the device comprising:

a cavity assembly having a cooking chamber formed therein;

a porous portion provided on a surface of the cavity assembly;

an insulator installed on the surface of the cavity assembly on which the porous portion is provided, wherein the insulator includes:

a heater opening portion corresponding to the porous portion; and extension ribs that extend downward from a periphery of the heater opening portion;

a heater base having a rectangular frame shape, wherein the heater base is positioned within an outer peripheral edge of the heater opening portion; and a choke portion provided along an inner peripheral edge of the heater base, with an outer periphery thereof positioned adjacent to the extension ribs of the insulator, so as to prevent microwaves supplied into the cooking chamber from leaking, wherein the choke portion comprises a plurality of choke pieces that extend from the inner peripheral edge of the heater base and a plurality of indented sections, wherein the plurality of choke pieces and the plurality of indented sections are arranged in a sequential alternating pattern at predetermined intervals along the inner peripheral edge of the heater base; and a heater assembly installed on an upper portion of the heater opening portion so as to generate heating energy to be supplied into the cooking chamber.

7. The device as claimed in claim 5 or 6, wherein the heater assembly is fixed to the heater base.

8. A device for preventing microwave leakage for a microwave oven, the device comprising:

a cavity assembly having a cooking chamber formed therein;

a heater opening portion formed in a surface of the cavity assembly, the heater opening portion communicating with the cooking chamber;

an insulator installed on the surface of the cavity assembly, the insulator comprising:

an opening formed therein corresponding to the heater opening portion formed in the surface of the cavity assembly; and extension ribs extending downward along a peripheral edge of the opening; and a heater assembly installed on an upper portion of the heater opening portion so as to generate heating energy to be supplied into the cooking chamber through the heater opening portion, wherein the heater assembly includes a choke portion having an outer periphery thereof positioned adjacent to the extension ribs of the insulator so as to prevent microwaves supplied into the cooking chamber from leaking through a gap between the cavity assembly and the heater assembly, wherein the choke portion comprises a plurality of choke pieces and a plurality of indented sections arranged in a sequential alternating pattern at predetermined intervals along an inner peripheral edge of the heater assembly.

9. The device as claimed in claim 8, wherein the heater assembly comprises:

at least one heater for generating light or heat;

a heater supporter fixed to a surface of the cavity assembly with the at least one heater fixed to the heater supporter; and a reflecting plate that reflects the light or heat generated by the at least one heater into the cooking chamber, wherein the choke portion is formed integrally with the heater supporter or the reflecting plate.

10. The device as claimed in claim 8, wherein the heater assembly comprises:

at least one heater for generating light or heat;

a heater supporter fixed to a surface of the cavity assembly with the at least one heater fixed to the heater supporter;

a reflecting plate that reflects the light or heat generated by the at least one heater into the cooking chamber; and a covering member that covers the heater opening portion, the at least one heater, the heater supporter and the reflecting plate, wherein the choke portion is formed integrally with the covering member.

11. A device for preventing microwave leakage for a microwave oven, the device comprising:

a cavity assembly having a cooking chamber formed therein;

a heater assembly provided at a side of the cavity assembly so as to supply light or heat for heating food into the cooking chamber through an opening portion in communication with the cooking chamber;

an insulator installed on the side of the cavity assembly, the insulator comprising:

an opening formed therein corresponding to the opening portion; and extension ribs extending downward along a peripheral edge of the opening; and leakage preventing means having an outer peripheral edge thereof positioned adjacent to the extension ribs of the insulator so as to prevent microwaves from leaking through a gap between the cavity assembly and the heater assembly, wherein the leakage preventing means comprises a plurality of choke pieces and a plurality of indented sections arranged in a sequential alternating pattern at predetermined intervals along an inner peripheral edge portion thereof, in a position corresponding to the opening portion.

12. The device as claimed in claim 11, wherein the leakage preventing means comprises a choke member provided between the cavity assembly and the heater assembly, the choke member comprising a choke portion including the plurality of choke pieces and the plurality of indented sections so as to prevent microwave leakage.

13. The device as claimed in claim 11, wherein the leakage preventing means comprises a choke portion including the plurality of choke pieces and the plurality of indented sections, wherein the choke portion is installed on a heater base to which the heater assembly is fixed.

14. The device as claimed in claim 13, wherein the heater base is fixed to an insulator provided on the surface of the cavity assembly.

15. The device as claimed in claim 11, wherein the heater assembly comprises:

at least one heater that generates light or heat;

a heater supporter fixed to the surface of the cavity assembly with the at least one heater fixed to the heater supporter;

a reflecting plate that reflects the light or heat generated by the at least one heater into the cooking chamber; and a covering member that covers the heater opening portion, the heater, the heater supporter and the reflecting plate, wherein the choke portion is installed on any one of the heater supporter, the reflecting plate or the covering member.

* * * * *